US011249431B2

(12) United States Patent
Ohishi

(10) Patent No.: US 11,249,431 B2
(45) Date of Patent: Feb. 15, 2022

(54) SHEET FEEDING DEVICE AND IMAGE FORMING APPARATUS INCORPORATING THE SHEET FEEDING DEVICE

(71) Applicant: Shinya Ohishi, Kanagawa (JP)

(72) Inventor: Shinya Ohishi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 27 days.

(21) Appl. No.: 16/874,500

(22) Filed: May 14, 2020

(65) Prior Publication Data

US 2020/0379396 A1 Dec. 3, 2020

(30) Foreign Application Priority Data

May 29, 2019 (JP) ..... JP2019-100259

(51) Int. Cl.
*G03G 15/00* (2006.01)
*B65H 7/04* (2006.01)
*B65H 1/04* (2006.01)

(52) U.S. Cl.
CPC ..... *G03G 15/6511* (2013.01); *B65H 1/04* (2013.01); *B65H 7/04* (2013.01); *G03G 15/5062* (2013.01)

(58) Field of Classification Search
CPC ..... B65H 2220/01; B65H 1/266; B65H 2220/02; B65H 2801/06; G03G 15/6511; G03G 15/6529; G03G 2215/00396; G03G 2215/00383; G03G 2215/00392
See application file for complete search history.

(56) References Cited

U.S. PATENT DOCUMENTS 5,216,474 A * 6/1993 Nakao ..... G03G 15/234 271/163
6,308,948 B1 * 10/2001 Azumi ..... B42C 1/12 270/58.01
9,745,156 B2 * 8/2017 Kohama ..... B41J 11/0075
2011/0233851 A1 * 9/2011 Sugishima ..... B65H 1/266 271/153
2016/0376116 A1 * 12/2016 Suzuki ..... B65H 7/06 271/262

FOREIGN PATENT DOCUMENTS

JP 2003-237985 8/2003
JP 2016-041621 3/2016

* cited by examiner

*Primary Examiner* — Walter L Lindsay, Jr.
*Assistant Examiner* — Jessica L Eley
(74) *Attorney, Agent, or Firm* — Duft & Borrnsen, PC

(57) ABSTRACT

A sheet feeding device includes an upper sheet container, a lower sheet container, and a sheet detector. The lower sheet container disposed below the removable upper sheet container is configured to contain a sheet. The sheet detector is configured to detect the sheet in the lower sheet container and includes a sheet contact member disposed above the lower sheet container. The sheet contact member is contactable to the upper sheet container and the sheet in the lower sheet container. Either the upper sheet container or the sheet contact member has a sloped face inclined downward from downstream toward upstream in a container insertion direction, on at least one of a downstream side in the container insertion direction of a lower portion of the upper sheet container and an upstream side in the container insertion direction of an upper portion of the sheet contact member.

7 Claims, 5 Drawing Sheets

SHEET FEEDING DEVICE AND IMAGE FORMING APPARATUS INCORPORATING THE SHEET FEEDING DEVICE

CROSS-REFERENCE TO RELATED APPLICATION

This patent application is based on and claims priority pursuant to 35 U.S.C. § 119(a) to Japanese Patent Application No. 2019-100259, filed on May 29, 2019, in the Japan Patent Office, the entire disclosure of which is hereby incorporated by reference herein.

BACKGROUND

Technical Field

This disclosure relates to a sheet feeding device and an image forming apparatus incorporating the sheet feeding device.

Background Art

Various types of known image forming apparatuses such as a copier, printer, facsimile machine, or a multi-functional apparatus including at least two of these functions also include a sheet feeding device incorporating a plurality of sheet trays (sheet containers) that is removably inserted in the image forming apparatus and disposed in multiple vertically stacked stages. Each of the plurality of sheet trays includes a bundle of sheets of recording media on which an image is to be formed.

SUMMARY

At least one aspect of this disclosure provides a novel sheet feeding device including an upper sheet container, a lower sheet container, and a sheet detector. The upper sheet container is removably attachable to an image forming apparatus. The lower sheet container is disposed below the upper sheet container and configured to contain a sheet. The sheet detector is configured to detect the sheet in the lower sheet container. The sheet detector includes a sheet contact member disposed above the lower sheet container. The sheet contact member is contactable to the upper sheet container and the sheet contained in the lower sheet container. The upper sheet container has a sloped face inclined downward from downstream toward upstream in a container insertion direction in which the upper sheet container is inserted into the image forming apparatus, provided on at least one of a downstream side in the container insertion direction of a lower portion of the upper sheet container and an upstream side in the container insertion direction of an upper portion of the sheet contact member.

Further, at least one aspect of this disclosure provides an improved image forming apparatus includes an image forming device configured to form an image on a sheet, and the above-described sheet feeding device configured to feed the sheet to the image bearer.

Further, at least one aspect of this disclosure provides a novel sheet feeding device including an upper sheet container, a lower sheet container, and a sheet detector. The upper sheet container is removably attachable to an image forming apparatus. The lower sheet container is disposed below the upper sheet container and configured to contain a sheet. The sheet detector is configured to detect the sheet in the lower sheet container. The sheet detector includes a sheet contact member disposed above the lower sheet container. The sheet contact member is contactable to the upper sheet container and the sheet contained in the lower sheet container. The sheet contact member has a sloped face inclined downward from downstream toward upstream in a container insertion direction in which the upper sheet container is inserted into the image forming apparatus, provided on at least one of a downstream side in the container insertion direction of a lower portion of the upper sheet container and an upstream side in the container insertion direction of an upper portion of the sheet contact member.

Further, at least one aspect of this disclosure provides an improved image forming apparatus includes an image forming device configured to form an image on a sheet, and the above-described sheet feeding device configured to feed the sheet to the image bearer.

BRIEF DESCRIPTION OF THE SEVERAL VIEWS OF THE DRAWINGS

Exemplary embodiments of this disclosure will be described in detail based on the following figures, wherein.

Figure 1:
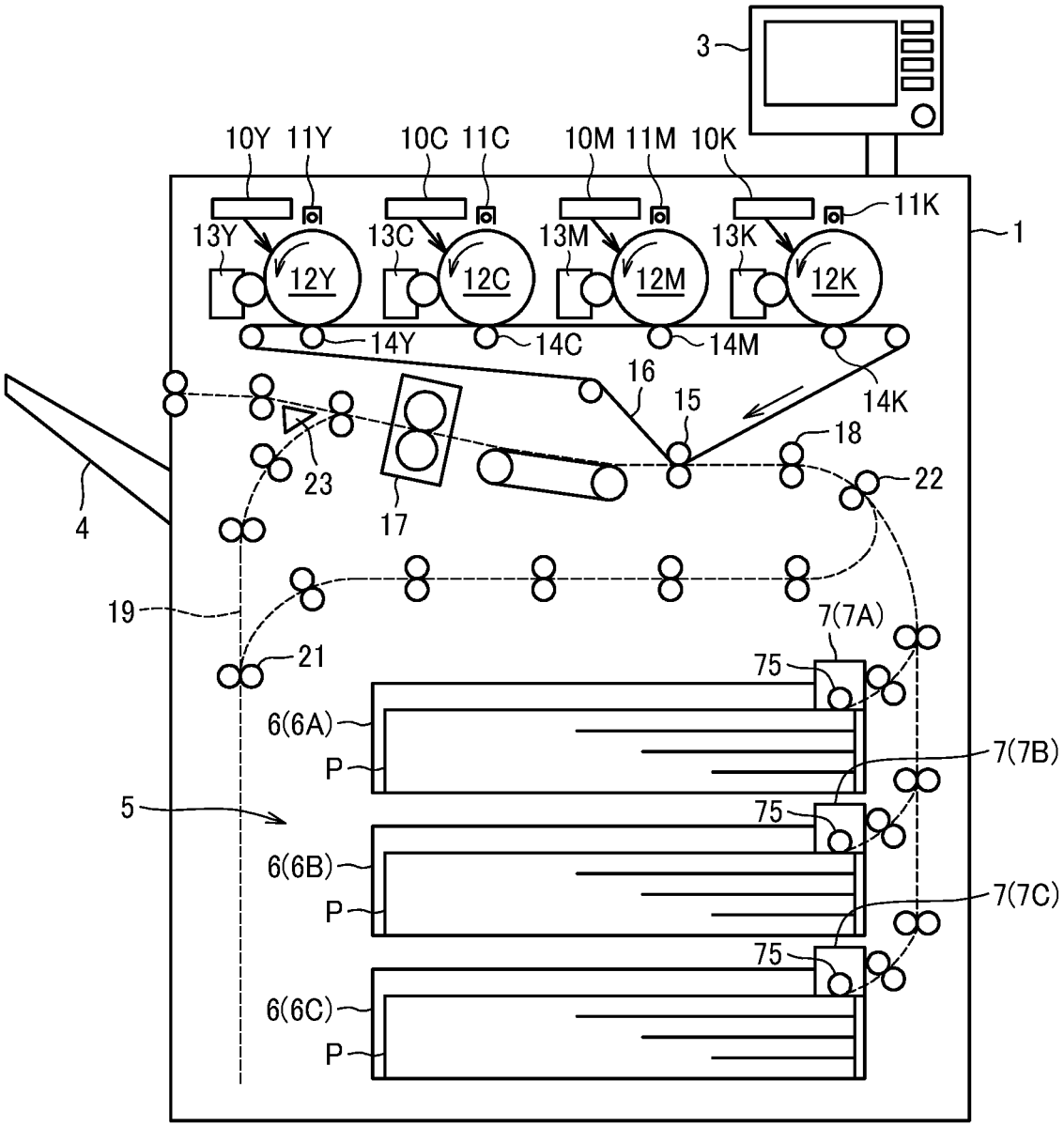
FIG. 1 is a schematic diagram illustrating a schematic configuration of an image forming apparatus according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Descriptions are given of an example applicable to a sheet feeding device and an image forming apparatus incorporating the sheet feeding device, with reference to the following drawings. Note that identical parts are given identical reference numerals and redundant descriptions are summarized or omitted accordingly.

FIG. 1 is a schematic diagram illustrating a schematic configuration of an image forming apparatus 1 according to an embodiment of this disclosure.

As illustrated in FIG. 1, the image forming apparatus 1 includes an intermediate transfer belt 16. The intermediate transfer belt 16 moves while being stretched over a plurality of rollers. On the upper side in FIG. 1, photoconductors 12Y, 12C, 12M, and 12K are provided for forming yellow (Y), cyan (C), magenta (M), and black (K) images, respectively. Hereinafter, the photoconductors 12Y, 12C, 12M, and 12K are occasionally referred collectively to as a photoconductor 12 in a singular form, for convenience. The photoconductor 12 (that is, the photoconductors 12Y, 12C, 12M, and 12K) that functions as an image bearer is surrounded by a laser scanning unit 10 (that is, laser scanning units 10Y, 10C, 10M, and 10K), a charging unit 11 (that is, charging units 11Y, 11C, 11M, and 11K), a developing unit 13 (that is, developing units 13Y, 13C, 13M, and 13K), and a primary transfer roller 14 (that is, primary transfer rollers 14Y, 14C, 14M, and 14K). The primary transfer roller 14 is disposed facing the photoconductor 12 while sandwiching the intermediate transfer belt 16 with the photoconductor 12. The laser scanning units 10Y, 10C, 10M, and 10K, the photoconductors 12Y, 12C, 12M, and 12K, the charging units 11Y, 11C, 11M, and 11K, and the developing units 13Y, 13C, 13M, and 13K are included in an image forming device to form an image on a sheet. In the present embodiment, an electrophotographic image forming device is employed as the image forming device. However, an inkjet image forming device including inkjet print heads may be employed alternative to the electrophotographic image forming device.

A secondary transfer roller 15 is provided in a secondary transfer portion and below the intermediate transfer belt 16. After being transferred onto the intermediate transfer belt 16 by primary transfer, a toner image is then transferred onto a sheet P by secondary transfer. A fixing device 17 is disposed downstream from the secondary transfer portion having the secondary transfer roller 15, in a sheet conveyance direction in which the sheet P is conveyed. A control panel 3 is disposed on top of the housing of the image forming apparatus 1 in FIG. 1. A sheet ejection tray 4 is disposed on the left-side face of the housing of the image forming apparatus 1 in FIG. 1. Further, a sheet feeding device 5 is provided in a lower part of the image forming apparatus 1. The sheet feeding device 5 includes three sheet trays 6 that function as sheet containers. To be more specific, the sheet feeding device 5 includes a first sheet tray 6A that functions as a first sheet container, a second sheet tray 6B that functions as a second sheet container, and a third sheet tray 6C that functions as a third sheet container. The sheet feeding device 5 further includes three sheet feeding units 7 that function as sheet feeders. To be more specific, the sheet feeding device 5 includes a first sheet feeding unit 7A that functions as a first sheet feeder, a second sheet feeding unit 7B that functions as a second sheet feeder, and a third sheet feeding unit 7C that functions as a third sheet feeder. The first sheet feeding unit 7A, the second sheet feeding unit 7B, and the third sheet feeding unit 7C are provided for the first sheet tray 6A, the second sheet tray 6B, and the third sheet tray 6C, respectively. Hereinafter, the first sheet tray 6A, the second sheet tray 6B, and the third sheet tray 6C may be referred to collectively as the sheet tray 6 in a singular form. Similarly, the first sheet feeding unit 7A, the second sheet feeding unit 7B, and the third sheet feeding unit 7C may be referred to collectively as the sheet feeding unit 7. The sheet tray 6, i.e., the first sheet tray 6A, the second sheet tray 6B, and the third sheet tray 6C, contains a sheet P (or sheets P) such as a transfer sheet and a resin film. A user selects one of the first sheet tray 6A, the second sheet tray 6B, and the third sheet tray 6C for feeding the sheet(s) P via the control panel 3 or an external input terminal such as a personal computer. The image forming apparatus 1 further includes a control device that functions as a controller including various units, for example, a central processing unit (CPU), a random-access memory (RAM), and a read only memory (ROM), to control the image forming apparatus 1.

As the image forming apparatus 1 having the above-described configuration starts an image forming operation, the photoconductor 12 (i.e., the photoconductors 12Y, 12C, 12M, and 12K) are driven to rotate in a counterclockwise direction in FIG. 1. At this time, the surface of the photoconductor 12 is uniformly charged by the charging unit 11 (i.e., the charging units 11Y, 11C, 11M, and 11K) to a given polarity. Then, the laser scanning unit 10 (i.e., the laser scanning units 10Y, 10C, 10M, and 10K) emits laser light based on image data, onto the charged surface of the photoconductor 12, thereby forming an electrostatic latent image on the surface of the photoconductor 12. In other words, the photoconductor 12 bears an image on the surface. Then, the developing unit 13 (i.e., the developing units 13Y, 13C, 13M, and 13K) develops the electrostatic latent image formed on the surface of the photoconductor 12 into a visible toner image. The toner image is transferred onto the surface of the intermediate transfer belt 16 by the primary transfer roller 14 (i.e., the primary transfer rollers 14Y, 14C, 14M, and 14K). Note that residual toner remains on the surface of the photoconductor 12 after the primary transfer of the toner image onto the intermediate transfer belt 16. Such residual toner is removed by a photoconductor cleaning unit provided in the housing of the image forming apparatus 1.

When forming a color image, the above-described image forming operation is performed in the photoconductors 12Y, 12C, 12M, and 12K, so that a yellow toner image, a cyan toner image, a magenta toner image, and a black toner image formed on respective photoconductors 12Y, 12C, 12M, and 12K are sequentially transferred onto the intermediate transfer belt 16 in a superimposed manner.

On the other hand, any one of the first sheet tray 6A, the second sheet tray 6B, and the third sheet tray 6C disposed in the lower part of the housing of the image forming apparatus 1 is selected according to the sheet P to be used for image formation. After the sheet tray 6 to be used is selected among the first sheet tray 6A, the second sheet tray 6B, and the third sheet tray 6C by a user via the control panel 3 or the external input terminal such as a personal computer, the sheet P is fed from the selected sheet tray 6 of the sheet feeding device 5. The sheet P fed from the selected sheet tray 6 is sent out by a sheet feed roller 75 toward a pair of registration rollers 18 until the leading end of the sheet P contacts the pair of registration rollers 18 that is not rotating. By contacting the pair of registration rollers 18, the sheet P is aligned. Thereafter, in synchrony with movement of the above-described toner image, the pair of registration rollers 18 feeds the sheet P toward the secondary transfer portion of the intermediate transfer belt 16 on which the secondary transfer roller 15 is provided. Then, the secondary transfer roller 15 transfers the toner image onto the surface of the intermediate transfer belt 16. After the toner image has been transferred onto the sheet P, the sheet P is conveyed to the fixing device 17, where the unfixed toner image is fixed, and then is ejected to the sheet ejection tray 4. Note that residual toner remains on the surface of the intermediate transfer belt 16 after the secondary transfer of the toner image onto the sheet P. Such residual toner is removed by an intermediate transfer belt cleaning unit provided in the housing of the image forming apparatus 1.

In a case in which a duplex printing mode for the sheet P is selected via the control panel 3 or the external input terminal such as a personal computer, a switching claw 23 switches and changes an orientation (sheet conveyance passage) of the sheet P, so that the sheet P having an image on a first face (front face) is conveyed to a duplex printing passage 19. Then, the sheet P is conveyed to a pair of sheet reverse rollers 21. After being conveyed to the pair of sheet reverse rollers 21 by the switching claw 23, the sheet P is then conveyed to a pair of duplex printing rollers by forward rotations and reverse rotations of the pair of sheet reverse rollers 21. At this time, both the front and back sides of the sheet P with respect to a sheet conveyance direction are reversed from the state in which the image is formed on the first face (front face) of the sheet P. After the sheet P is conveyed from a pair of relay rollers 22 to the pair of registration rollers 18, an image is formed on the second face (back face) by the same process as the above-described process for printing an image on the first face of the sheet P, and then the sheet P is ejected to the sheet ejection tray 4.

As an option, a large-capacity sheet bank that is capable of loading a large number of sheets may be attached to the image forming apparatus 1 having the above-described configuration. Alternatively, a post-processing apparatus (or a finisher) that is capable of stapling and folding the sheet(s) may be provided instead of the sheet ejection tray 4.

Next, a description is given of the sheet tray 6 (i.e., the first sheet tray 6A, the second sheet tray 6B, and the third sheet tray 6C) and the sheet feeding unit 7 (the sheet feeder) (i.e., the first sheet feeding unit 7A, the second sheet feeding unit 7B, and the third sheet feeding unit 7C) included in the sheet feeding device 5.

The sheet feeding unit 7 is provided with a sheet detector that detects a sheet or sheets in the sheet tray 6. Note that the first sheet tray 6A, the second sheet tray 6B, and the third sheet tray 6C have basically identical structures and that the first sheet feeding unit 7A, the second sheet feeding unit 7B, and the third sheet feeding unit 7C also have basically identical structures.

Figure 2:
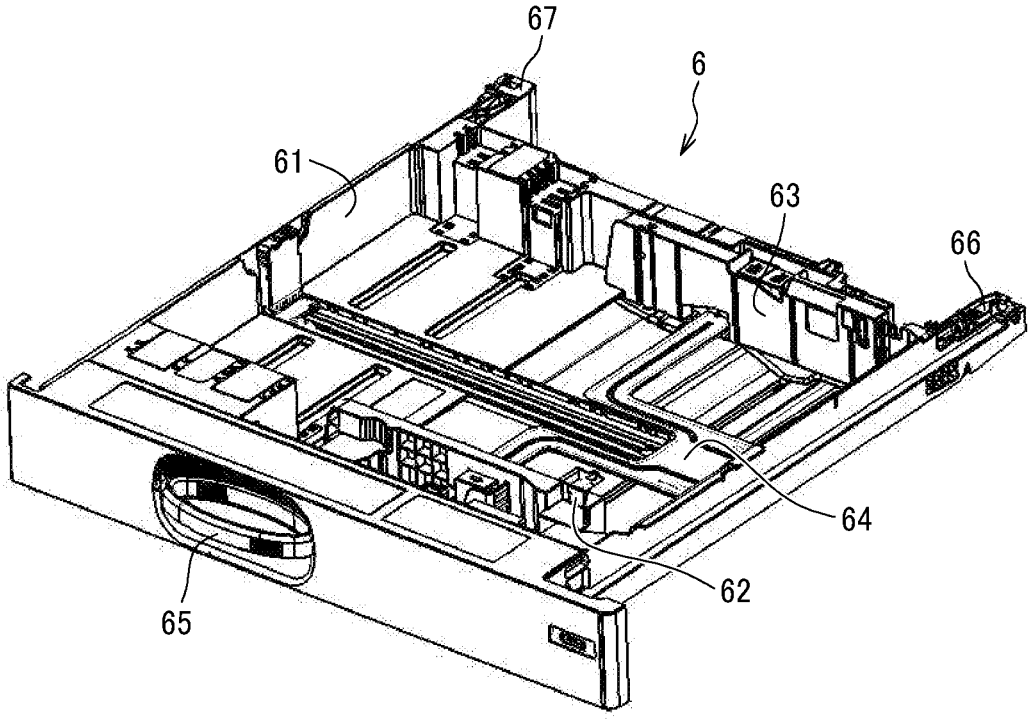
FIG. 2 is a perspective view illustrating a sheet tray included in a sheet feeding device of the image forming apparatus of FIG. 1.

FIG. 2 is a perspective view illustrating the sheet tray 6 included in a sheet feeding device 5 of the image forming apparatus 1 of FIG. 1.

As illustrated in FIG. 2, the sheet tray 6 includes a tray housing 61, a front fence 62, a rear fence 63, and a bottom plate 64. The tray housing 61 has a shape of a box with an open top. The front fence 62 and the rear fence 63 are provided in the tray housing 61. The bottom plate 64 is vertically movable to the tray housing 61 by a drive unit.

A handle 65 is provided to the tray housing 61. Grasping the handle 65, a user inserts (installs) the sheet tray 6 in the image forming apparatus 1 in a container insertion direction that is from the near side to the far side of the drawing sheet of FIG. 1 and removes (pulls out) the sheet tray 6 from the image forming apparatus 1 in a container removal direction from the far side to the near side of the drawing sheet of FIG. 1, that is opposite to the container insertion direction. Further, extensions 66 and 67 are provided on each end of the tray housing 61, downstream from the handle 65 in the container insertion direction. The extensions 66 and 67 are extended toward downstream in the container insertion direction. By retaining the tray housing 61 to the image forming apparatus 1 at the extensions 66 and 67, the sheet tray 6 is retained to the image forming apparatus 1 in a in a state in which a sheet containing portion of the tray housing 61 is exposed outside.

The front fence 62 is disposed on the upstream side in the container insertion direction of the tray housing 61 and the rear fence 63 is disposed on the downstream side in the container insertion direction of the tray housing 61. Hereinafter, the upstream side in the container insertion direction of the tray housing 61 is also referred to as a front of the sheet tray 6 and the downstream side in the container insertion direction of the tray housing 61 is also referred to as a rear of the sheet tray 6. Further, the container insertion direction of the tray housing 61 of the sheet tray 6 and the container removal direction of the tray housing 61 of the sheet tray 6 are also referred to simply as a container insertion direction and a container removal direction or are referred to collectively as a tray insertion and removal direction.

A bundle of sheets P corresponding to each sheet tray 6 is loaded (contained) between the front fence 62 and the rear fence 63 on the bottom plate 64. The front fence 62 and the rear fence 63 regulate the position in the tray insertion and removal direction of the bundle of sheets P in the tray housing 61.

As the sheet tray 6 in which the bundle of sheets P is contained in the tray housing 61 is set (inserted) in the housing of the image forming apparatus 1, a driving mechanism lifts the bottom plate 64 to set the bundle of sheets at a position at which the sheet feeding unit 7 is capable of feeding an uppermost sheet P of the bundle of sheets P toward the downstream side in the sheet conveyance direction. In this state, the uppermost sheet P comes into contact with a sheet detector. Detail of the sheet detector is described below.

Next, a description is given of the sheet feeding unit 7 disposed above an upper part of the sheet tray 6 and a sheet detector included in the sheet feeding unit 7.

Figure 3:
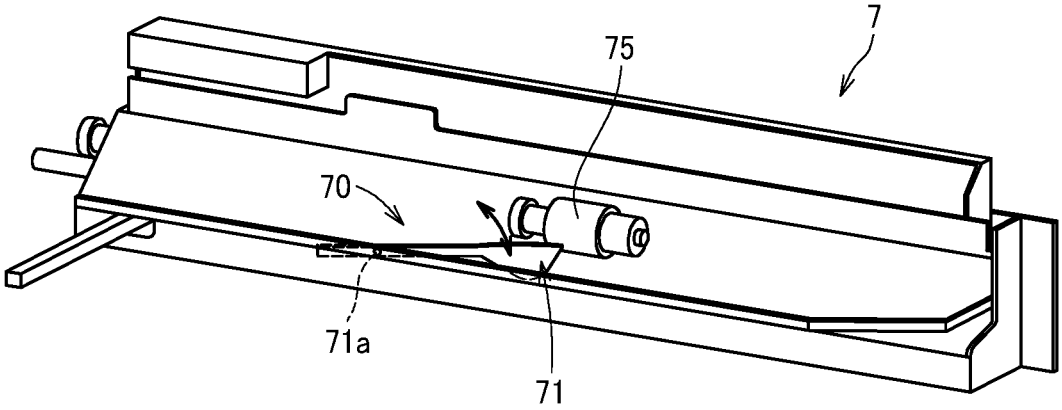
FIG. 3 is a perspective view of a sheet feeding unit included in the sheet feeding device of the image forming apparatus of FIG. 1.

FIG. 3 is a perspective view of the sheet feeding unit 7 included in the sheet feeding device 5 of the image forming apparatus 1 of FIG. 1.

As illustrated in FIG. 3, the sheet feeding unit 7 includes a sheet detector 70 and the sheet feed roller 75. The sheet feeding unit 7 is disposed above the upper part of the sheet tray 6 when the sheet tray 6 is inserted and set in the housing of the image forming apparatus 1, as illustrated in FIG. 1. The sheet detector 70 detects the sheet P in the sheet tray 6. Note that FIG. 3 illustrates the above-described members alone to simplify the drawing for convenience.

Figure 4A:
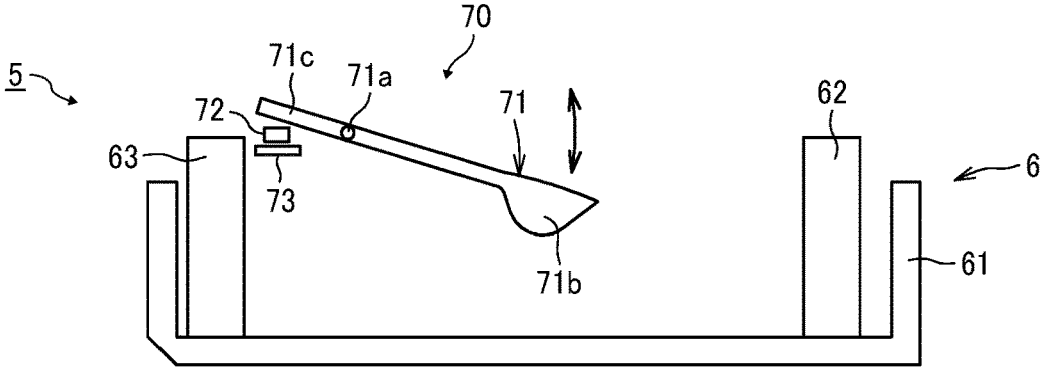
FIG. 4A is a side view illustrating a sheet detector disposed above an upper part of the sheet tray when no sheet is loaded in the sheet tray.
Figure 4B:
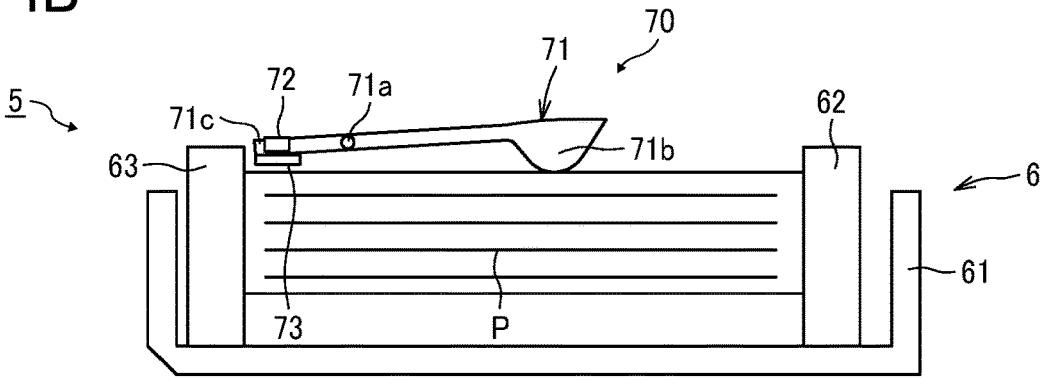
FIG. 4B is a side view illustrating the sheet detector disposed above the upper part of the sheet tray when sheets are loaded in the sheet tray.

FIG. 4A is a side view illustrating the sheet detector 70 disposed above the upper part of the sheet tray 6 when no sheet is loaded in the sheet tray 6. FIG. 4B is a side view illustrating the sheet detector 70 disposed above the upper part of the sheet tray 6 when sheets are loaded in the sheet tray 6.

As illustrated in FIG. 4A, the sheet detector 70 includes a sheet contact member 71 and a sensor 72. The sheet contact member 71 of the sheet detector 70 contacts the sheet P in the sheet tray 6.

The sheet contact member 71 is rotatably supported on a frame of the sheet feeding unit 7 to rotate about a rotational center portion 71*a* in a vertical direction indicated by a bidirectional arrow in FIG. 4A. The sheet contact member 71 includes a contact portion 71*b* of enhanced thickness to contact the sheet P. The contact portion 71*b* of the sheet contact member 71 is thicker than any other portions of the sheet contact member 71. The contact portion 71*b* has a curved surface which the sheet P contacts.

The sheet contact member 71 further includes an end portion 71*c* opposite the contact portion 71*b*. The sensor 72 is disposed on the opposite side of the contact portion 71*b*, that is, on the same side as the end portion 71*c* of the sheet contact member 71, from the rotational center portion 71*a* of the sheet contact member 71. The sensor 72 according to the present embodiment is a photointerrupter that changes state as light is blocked by the end portion 71*c* of the sheet contact member 71. The sheet detector 70 that includes the sheet contact member 71 and the sensor 72 is disposed at a position corresponding to one end of the rear fence 63 provided on the sheet tray 6, that is, on the right side in FIG. 2.

While no external force is applied to the sheet contact member 71, the contact portion 71*b* hangs down under its own weight due to having the greater thickness than the other portions of the sheet contact member 71. In this state, the end portion 71*c* of the sheet contact member 71 is located higher than the sensor 72, and therefore is not disposed facing the sensor 72, in other words, is not overlaid on the drawing sheet of FIG. 4A. Accordingly, the light emitted by the sensor 72 is passed (i.e., is not blocked). This state is referred to as a light transmitting state. On the other hand, in a state in which the bundle of sheets P is loaded (contained) in the sheet tray 6, the contact portion 71*b* of the sheet contact member 71 is lifted by the bundle of sheets P. Therefore, as illustrated in FIG. 4B, the end portion 71*c* of the sheet contact member 71 contacts a positioning portion 73 that is mounted on the sheet feeding unit 7. In this state, the end portion 71*c* of the sheet contact member 71 is disposed facing the sensor 72, and therefore the light emitted by the sensor 72 is blocked. This state is referred to as is a light blocking state.

As described above, the posture (position) of the sheet contact member 71 changes depending on whether the bundle of sheets P contacts the contact portion 71*b*, so as to change whether the end portion 71*c* of the sheet contact member 71 faces the sensor 72. That is, the detection state of the sensor 72 changes depending on whether or not the sheet P is contained in the sheet tray 6. According to this change of the detection state of the sensor 72, a sheet setting state, that is, whether the bundle of sheets P is set in the sheet tray 6, is detected.

As described above, the contact portion 71*b* of the sheet contact member 71 is disposed in the sheet tray 6 (see FIG. 4A) or is disposed in contact with the uppermost sheet P placed on top of the bundle of sheets P (see FIG. 4B). Consequently, when inserting the sheet tray 6 into the housing of the image forming apparatus 1 or removing the sheet tray 6 from the image forming apparatus 1, the sheet contact member 71 is retracted from a range of movement of the bundle of sheets P loaded in the sheet tray 6, so as to prevent the sheet contact member 71 from being damaged or broken.

Hereinafter, a description is given of the configuration and operations of the sheet tray 6 for retracting the sheet contact member 71 according to the present embodiment.

Figure 5:
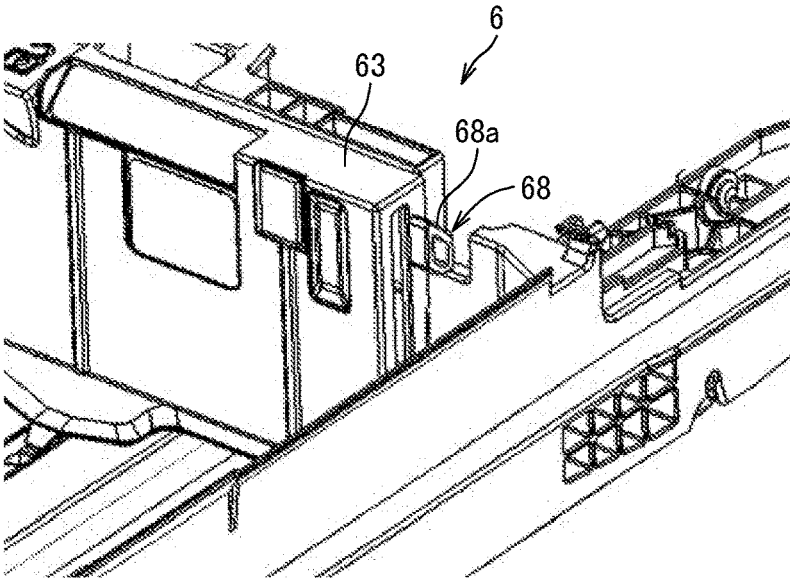
FIG. 5 is a perspective view illustrating an enlarged part of the sheet tray.

FIG. 5 is a perspective view illustrating an enlarged part of the sheet tray 6. Specifically, FIG. 5 illustrates an enlarged view of one end (that is, the right side in FIG. 2) of the rear fence 63 of the sheet tray 6.

As illustrated in FIG. 5, a push-up portion 68 is provided on the end of the rear fence 63 where the push-up portion 68 comes to face the sensor 72. The push-up portion 68 is disposed projecting further outward from the surface of the one end of the rear fence 63. Further, the push-up portion 68 has a sloped face 68*a* on the upper surface side.

Figure 6A:
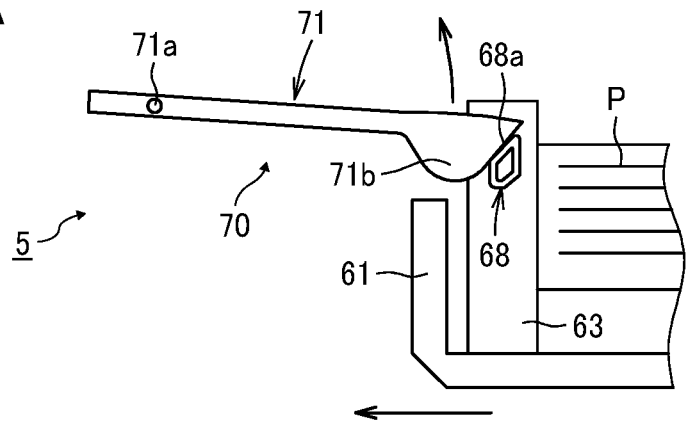
FIGS. 6A, 6B, and 6C are diagrams illustrating changes in the posture of a sheet contact member when the sheet tray is inserted into the image forming apparatus.
Figure 6B:
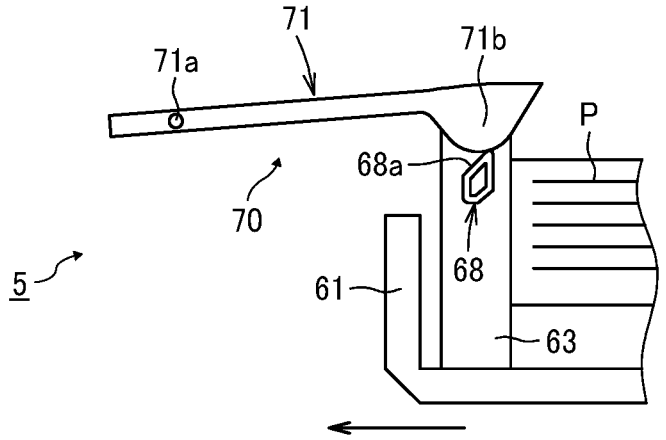
Figure 6C:
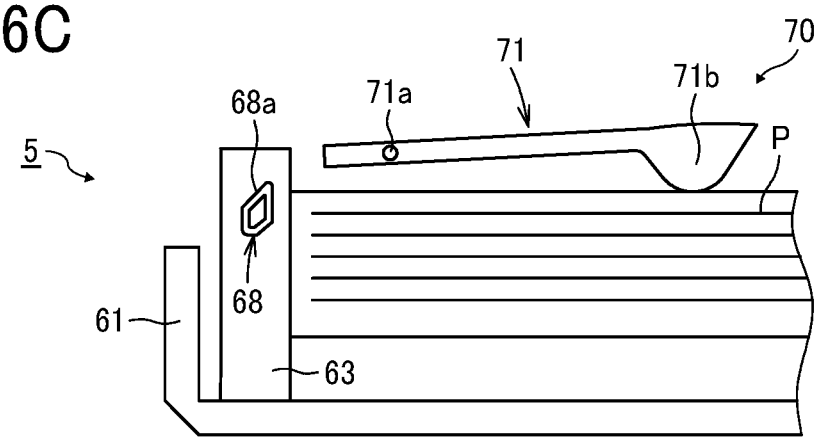

Next, a description is given of movements of the push-up portion 68 and the sheet contact member 71 when the sheet tray 6 is inserted in or removed from the image forming apparatus 1, with reference to FIGS. 6A, 6B, and 6C. Specifically, with reference to FIGS. 6A, 6B, and 6C, the following description explains that, when the sheet tray 6 is inserted in or removed from the image forming apparatus 1, the push-up portion 68 pushes up the contact portion 71*b* to retract the sheet contact member 71 from the range of movement of the bundle of sheets P.

When the sheet tray 6 is not attached (inserted) in the image forming apparatus 1, the sheet contact member 71 provided on the sheet feeding unit 7 is in a posture (attitude) in which the contact portion 71*b* hangs down under its own weight. (In other words, the sheet contact member 71 has the same posture as the posture illustrated in FIG. 4A.) In this state, as illustrated in FIG. 6A, when the user tries to insert the sheet tray 6 into the housing of the image forming apparatus 1 (in other words, when the user tries to push the sheet tray 6 in a direction indicated by arrow in FIG. 6A), the push-up portion 68 on the rear fence 63 provided downstream from the bundle of sheets P contained in the sheet tray 6 in the sheet conveyance direction contacts the sheet contact member 71. As illustrated in FIG. 5, the push-up portion 68 protrudes toward an end (the front in the drawing of FIG. 6A) from any other portions of the rear fence 63, and therefore the push-up portion 68 alone contacts the sheet contact member 71 among the whole portions of the rear fence 63 when the sheet tray 6 is inserted into or removed from the image forming apparatus 1.

When the sheet tray 6 is further moved in the container insertion direction, the sloped face 68*a* of the push-up portion 68 and the sloped face of the lower part of the contact portion 71*b* come to slide on each other. In other words, in the present embodiment, the sloped face of the lower part of the contact portion 71*b* slides on the sloped face 68*a* of the push-up portion 68. That is, the contact portion 71*b* is guided by the sloped face 68*a* of the push-up portion 68 to be pushed upward in FIG. 6A, so that the sheet contact member 71 rotates about the rotational center portion 71*a* in the counterclockwise direction in FIG. 6A. According to the rotation of the sheet contact member 71, the contact portion 71*b* retreats to a position above (higher) than the bundle of sheets P, as illustrated in FIG. 6B. Consequently, when the sheet tray 6 is inserted into the housing of the image forming apparatus 1, the contact portion 71*b* is prevented from contacting the bundle of sheets P in the container insertion direction.

When the sheet tray 6 is further inserted into the housing of the image forming apparatus 1, the contact portion 71*b* relatively moves on the sloped face 68*a* of the push-up portion 68, then climbs over the push-up portion 68. As a result, the push-up motion of the push-up portion 68 is released (in other words, the push-up portion 68 cancels the push-up motion). Then, as illustrated in FIG. 6C, the contact portion 71*b* contacts the uppermost sheet P placed on top of the bundle of sheets P from above.

Figure 7:
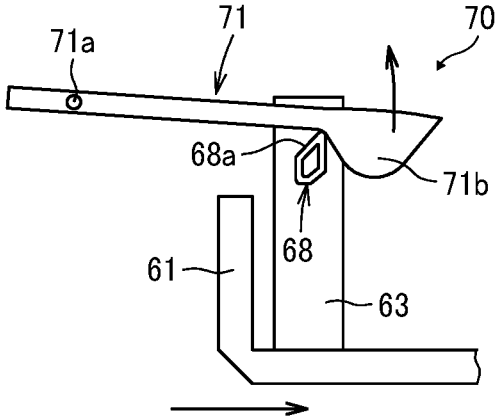
FIG. 7 is a side view illustrating a state in which the sheet tray is removed from the image forming apparatus.

FIG. 7 is a side view illustrating a state in which the sheet tray 6 is removed from the image forming apparatus 1.

When the sheet tray 6 is out of sheets P, the sheet tray 6 is removed (pulled out) from the image forming apparatus 1. In this case, as illustrated in FIG. 7, the push-up portion 68 comes into contact with the contact portion 71*b* from the upstream side (i.e., from the left side in the drawing) in the container removal direction. That is, while the push-up portion 68 pushes up the contact portion 71*b*, the sheet tray 6 moves in the container removal direction in which the sheet tray 6 is removed from the image forming apparatus 1.

As described above, when the sheet tray 6 is inserted into or removed from the image forming apparatus 1, the contact portion 71*b* is temporarily pushed up by the push-up portion 68, so that the sheet contact member 71 is retracted from the sheet tray 6 selected by a user.

On the other hand, the contact portion 71*b* that is pushed up by the push-up portion 68 is likely to contact another sheet tray 6 disposed above the sheet tray 6, to damage or break the sheet contact member 71. That is, in the image forming apparatus 1 according to the present embodiment, the sheet trays 6 (the first sheet tray 6A, the second sheet tray 6B, and the third sheet tray 6C) are disposed in a plurality of stages (see FIG. 1). In a case in which the sheet tray 6 disposed above the contact portion 71*b* at the timing when the contact portion 71*b* is lifted (in other words, in a case in which the first sheet tray 6A disposed above the second sheet tray 6B is inserted into the housing of the image forming apparatus 1 at the timing that the second sheet tray 6B in FIG. 1 is inserted into or removed from the image forming apparatus 1), it is likely that the contact portion 71*b* that has been lifted up collides with the first sheet tray 6A, resulting in damaging or breaking the sheet contact member 71.

Note that, as an example in which this inconvenience (the collision of the contact portion 71*b* with the first sheet tray 6A) occurs, replenishment of sheets is performed for the upper sheet tray 6 (e.g., the first sheet tray 6A) and the lower sheet tray 6 (e.g., the second sheet tray 6B) simultaneously. That is, after the upper sheet tray 6 pulled out from the image forming apparatus 1 has finished the replenishment of sheets, when the lower sheet tray 6 is pulled out without inserting the upper sheet tray 6 into the housing of the image forming apparatus 1, the upper sheet tray 6 hinders movement of the lower sheet tray 6, thereby preventing replenishment of sheets to the lower sheet tray 6. Note that, in a case in which the upper sheet tray 6 corresponds to the second sheet tray 6B, the lower sheet tray 6 may be the third sheet tray 6C.

In order to address this inconvenience, the upper sheet tray 6 is inserted into the housing of the image forming apparatus 1. As a result, the upper sheet tray 6 is inserted into the housing of the image forming apparatus 1 immediately after the lower sheet tray 6 is pulled out (removed) from the image forming apparatus 1, that is, at the timing that the contact portion 71*b* corresponding to the lower sheet tray 6 is lifted.

Known sheet containers include a sheet contact member and a sheet sensor. The sheet contact member contacts the bundle of sheets contained in the sheet container. The sheet sensor detects a sheet by detecting a change of the position of the sheet contact member. With the sheet contact member and the sheet sensor, an image forming apparatus detects whether there is a sheet or not in the sheet container. In such an image forming apparatus, when the sheet container is inserted to or removed from the image forming apparatus, even if the sheet contact member contacts the sheet container or the bundle of sheets in the sheet container, the sheet contact member is prevented from being damaged or broken by the contact with the known sheet container or the bundle of sheets in the sheet container.

For example, a known image forming apparatus includes a sheet detection feeler, a photointerrupter, and a feeler retracting member. The sheet detection feeler is rotatably disposed to be contactable to the sheets in the sheet tray (the sheet container). The photointerrupter switches turn-on and turn-off of light shielding by the sheet detection feeler depending on the posture (position) of the sheet detection feeler. The feeler retracting member retracts the sheet detection feeler. The feeler retracting member lifts the sheet detection feeler to retract the sheet detection feeler from the sheet tray. On the other hand, when the sheet tray is inserted into the housing of the image forming apparatus, the feeler retracting member cancels the lifting of the sheet detection feeler to locate the sheet detection feeler at a position at which the sheet detection feeler is contactable to the bundle of sheets contained in the sheet tray. With such a configuration, when inserting the sheet tray to or removing the sheet tray from the image forming apparatus, the feeler retracting member moves the sheet detection feeler to a position at which the sheet detection feeler does not contact the sheet tray when the sheet tray is inserted into or removed from the image forming apparatus, so that the sheet detection feeler is prevented from being damaged or broken.

As described above, the above-described known image forming apparatus employs the configuration in which the sheet contact member is lifted to move out of the movable range of the sheet container (the sheet tray). However, in a case in which the image forming apparatus includes a plurality of sheet containers stacked vertically in multiple stages, when a upper-stage sheet container is inserted to or removed from the image forming apparatus while a sheet contact member of a lower-stage sheet container is lifted, the upper-stage sheet container contacts the sheet contact member of the lower-stage sheet container, which is likely to damage or break the sheet contact member.

Figure 8:
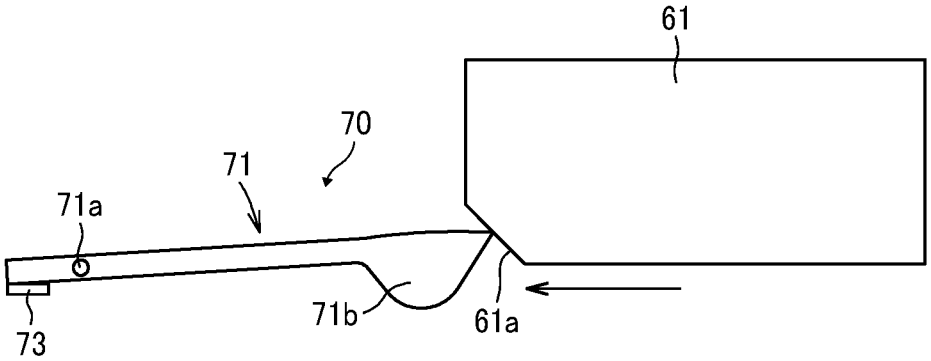
FIG. 8 is a side view illustrating a configuration of a sloped face provided to the sheet feeding device according to the present embodiment of this disclosure.

FIG. 8 is a side view illustrating a configuration of a sloped face provided to the sheet feeding device 5 according to the present embodiment of this disclosure.

In order to prevent the damage or breakage of the contact portion 71*b* described above, in the present embodiment, as illustrated in FIG. 8, a sloped face 61*a* is provided on a portion to which the contact portion 71*b* corresponding to the lower sheet tray 6 contacts when the upper sheet tray 6 is inserted into the housing of the image forming apparatus 1. To be more specific, the sloped face 61*a* is disposed on the lower side of the tray housing 61 of the sheet tray 6, on the downstream side in the container insertion direction of the tray housing 61 (that is, on the downstream side of the rear fence 63). The sloped face 61*a* is a surface of the sheet tray, sloped downward from the downstream side toward the upstream side in the container insertion direction (that is, from the left side to the right side in FIG. 8).

By providing the sloped face 61*a* on the tray housing 61 of the sheet tray 6, when the upper sheet tray 6 and the contact portion 71*b* of the lower sheet tray 6 contact each other in the container insertion direction, as illustrated in FIG. 8, the contact portion 71*b* is guided along the sloped face 61*a* in response to insertion of the upper sheet tray 6 (in the direction indicated by arrow in FIG. 8), so that the contact portion 71*b* slides under the lower side of the upper sheet tray 6 and moves relative to the upper sheet tray 6. That is, the sheet contact member 71 changes the position at which the sheet contact member 71 is rotated in the clockwise direction from the position of the sheet contact member 71 in FIG. 8. Accordingly, for example, when compared with a case in which the surface of the contact portion 71*b* contacts the surface of the tray housing 61, the above-described movement of the contact portion 71*b* relative to the tray housing 61 reduces the contact pressure, and therefore prevents damage or breakage of the sheet contact member 71.

Figure 9:
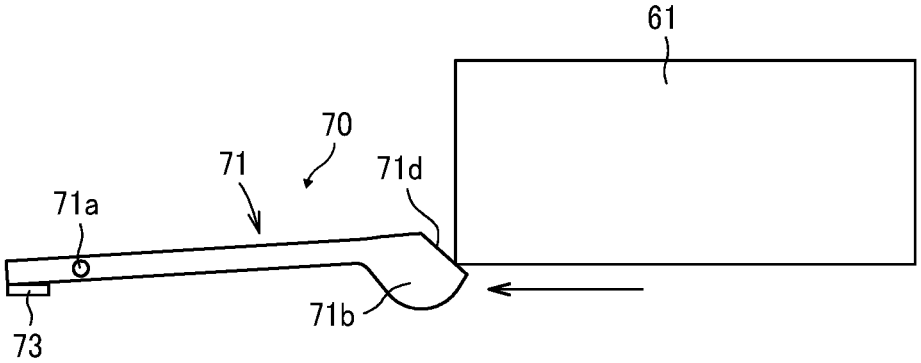
FIG. 9 is a side view illustrating a configuration of another sloped face that is different from the sloped face of FIG. 8 and is provided to the sheet feeding device according to the present embodiment of this disclosure.

Further, FIG. 9 is a side view illustrating a configuration of another sloped face that is different from the sloped face of FIG. 8 and is provided to the sheet feeding device 5 according to the present embodiment of this disclosure.

As illustrated in FIG. 9, a sloped face 71*d* may be provided on the surface of the upstream side of the contact portion 71*b* in the container insertion direction. Alternatively, a sloped face may be provided on each of the tray housing 61 and the contact portion 71*b*. Even in these cases, the contact load between the contact portion 71*b* and the tray housing 61 is reduced, and therefore the sheet contact member 71 is prevented from being damaged or broken.

The above-described sloped face 61*a* is provided on the upper sheet tray 6 (for example, the first sheet container) disposed above the lower sheet tray 6 (for example, the second sheet container) corresponding to the sheet contact member 71. That is, as illustrated in FIG. 1, the sloped face 61*a* is provided on the second sheet tray 6B when the third sheet tray 6C functions as a second sheet container or on the first sheet tray 6A when the second sheet tray 6B functions as a second sheet container. The sloped face 71*d* of the contact portion 71*b* is provided on the sheet contact member 71 included in the sheet feeding unit 7 corresponding to a second sheet container.

The above-described embodiments are illustrative and do not limit this disclosure. It is therefore to be understood that within the scope of the appended claims, numerous additional modifications and variations are possible to this disclosure otherwise than as specifically described herein.

The image forming apparatus according to the embodiments of the present disclosure is not limited to the color image forming apparatus 1 as illustrated in FIG. 1. Alternatively, the image forming apparatus may be a monochrome image forming apparatus that forms monochrome images on recording media. The image forming apparatus may be, e.g., a copier, a printer, a scanner, a facsimile machine, or a multifunction peripheral (MFP) having at least two of copying, printing, scanning, facsimile, and plotter functions.

In addition, the "sheet" includes the sheet P (plain papers), thick papers, postcards, envelopes, thin papers, coated papers (coated papers, art papers, etc.), tracing papers, OHP sheets, plastic films, prepreg, copper foil, etc.

In the above-described embodiment, the sloped face 61*a* is provided on the lower portion of the downstream side of the tray housing 61 of the sheet tray 6 in the container insertion direction. However, the position of the sloped face is not limited to the above-described configuration and is selected optionally according to the configuration of a sheet tray. That is, a sloped face may be provided on a portion to which the sheet tray 6 that moves in the container insertion direction contacts the sheet contact member 71 that is lifted.

In the above-described embodiment, the sloped face has an angle to the tray insertion and removal direction of the sheet tray. However, a sloped face may be a plurality of sloped faces having different angles or may have a curved surface.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the disclosure. These novel embodiments can be implemented in various other forms, and various omissions, replacements, or changes can be made without departing from the gist of the disclosure. These embodiments and their variations are included in the scope and gist of this disclosure, and are included in the scope of the disclosure recited in the claims and its equivalent.

Any one of the above-described operations may be performed in various other ways, for example, in an order different from the one described above.

What is claimed is:

1. A sheet feeding device comprising:

an upper sheet container removably attachable to an image forming apparatus;

a lower sheet container disposed below the upper sheet container and configured to contain a sheet; and a sheet detector configured to detect the sheet in the lower sheet container, the sheet detector including a sheet contact member disposed above the lower sheet container, the sheet contact member being contactable to the upper sheet container and the sheet contained in the lower sheet container, the upper sheet container having a sloped face inclined downward from downstream toward upstream in a container insertion direction in which the upper sheet container is inserted into the image forming apparatus, provided on at least one of a downstream side in the container insertion direction of a lower portion of the upper sheet container, wherein the upper sheet container is configured such that when inserted into the image forming apparatus, the sloped face of the upper sheet container contacts the sheet contact member, such that the sheet contact member is guided to move downward along the sloped face of the upper sheet container.

2. An image forming apparatus comprising:

an image forming device configured to form an image on a sheet; and the sheet feeding device according to claim 1, configured to feed to the sheet to the image forming device.

3. The image forming apparatus according to claim 2, wherein the image forming device is configured to form the image with toner.

4. A sheet feeding device comprising:

an upper sheet container removably attachable to an image forming apparatus;

a lower sheet container disposed below the upper sheet container and configured to contain a sheet; and a sheet detector configured to detect the sheet in the lower sheet container, the sheet detector including a sheet contact member disposed above the lower sheet container, the sheet contact member being contactable to the upper sheet container and the sheet contained in the lower sheet container, the sheet contact member having a sloped face inclined downward from downstream toward upstream in a container insertion direction in which the upper sheet container is inserted into the image forming apparatus, provided on an upstream side in the container insertion direction of an upper portion of the sheet contact member, wherein the upper sheet container is configured such that when inserted into the image forming apparatus, the sloped face of the upper sheet container contacts the sheet contact member, such that the sheet contact member is guided to move downward along the sloped face of the upper sheet container.

5. An image forming apparatus comprising:

an image forming device configured to form an image on a sheet; and the sheet feeding device according to claim 4, configured to feed to the sheet to the image forming device.

6. The image forming apparatus according to claim 5, wherein the image forming device is configured to form the image with toner.

7. A sheet feeding device comprising:

a first sheet tray removably attachable to an image forming apparatus;

a second sheet tray disposed below the first sheet tray in the image forming apparatus and configured to contain a sheet; and a sheet detector configured to detect the sheet in the second sheet tray, the sheet detector including a sheet contact member disposed above the second sheet tray, the sheet contact member being movable downward to contact the sheet contained in the second sheet tray and movable upward into a path of the first sheet tray being inserted into the image forming apparatus, the first sheet tray having a sloped face to contact the sheet contact member disposed in the path of the first sheet tray being inserted into the image forming apparatus, wherein the contact of the sloped face guides the sheet contact member downward to slide underneath the first sheet tray as the first sheet tray is inserted into the image forming apparatus.

* * * * *